US007520846B1

(12) United States Patent
Manuel

(10) Patent No.: US 7,520,846 B1
(45) Date of Patent: Apr. 21, 2009

(54) EXERCISE SYSTEM AND METHOD OF USE

(76) Inventor: Sean Christopher Manuel, 6350 Reseda Blvd. #105, Tarzana, CA (US) 91335

( * ) Notice: Subject to any disclaimer, the term of this patent is extended or adjusted under 35 U.S.C. 154(b) by 0 days.

(21) Appl. No.: 11/890,675

(22) Filed: Aug. 7, 2007

Related U.S. Application Data

(60) Provisional application No. 60/826,523, filed on Sep. 21, 2006.

(51) Int. Cl.
*A63B 26/00* (2006.01)

(52) U.S. Cl. ..... 482/142; 482/23

(58) Field of Classification Search ..... 482/121–126, 482/140, 23, 142
See application file for complete search history.

(56) References Cited

U.S. PATENT DOCUMENTS 189,356 A * 4/1877 Hanson et al. ..... 73/379.08
4,515,361 A * 5/1985 Melillo et al. ..... 482/140
4,671,257 A * 6/1987 Kaiser et al. ..... 601/34
5,820,532 A * 10/1998 Oliver ..... 482/123
6,228,004 B1 * 5/2001 Steinbach et al. ..... 482/121
6,241,642 B1 * 6/2001 Slenker ..... 482/114
6,629,913 B2 * 10/2003 Chen ..... 482/129
7,207,932 B1 * 4/2007 Dean ..... 482/140
2004/0014570 A1 * 1/2004 Centopani ..... 482/140

* cited by examiner

*Primary Examiner*—Fenn C Mathew
(74) *Attorney, Agent, or Firm*—Ted Masters

(57) ABSTRACT

An exercise system for use on a bed includes a bottom mat which is placed on the bed having a mattress and a top mat which is placed on top of the bottom mat. Two handles are connected to the top mat by a line. A user lies on his/her back and grasps one handle in each hand and pulls the handles up during an exercise. The upward motion of the handles causes the top mat to pull away from the mattress and support the head, neck, and shoulders of the user during the exercise. The exercise system also includes a support pad for selectively supporting the lower back, head, or other part of the user's body. The exercise system may also be used on the floor with or without the bottom mat.

7 Claims, 7 Drawing Sheets

38
32
30
24
20
22
36
40
30
26
28
500
34
502
504
505
44

EXERCISE SYSTEM AND METHOD OF USE

CROSS REFERENCE TO RELATED APPLICATION

This application claims the filing benefit under 35 U.S.C. §119(e) of U.S. Provisional Application No. 60/826,523 filed Sep. 21, 2006, which is herein incorporated by reference.

TECHNICAL FIELD

The present invention pertains generally to physical exercise, and more particularly to an exercise system and method which allows exercises to be performed on a bed or on the floor.

BACKGROUND OF THE INVENTION

Exercises are regularly performed by certain individuals to maintain their physical fitness. Some exercises such as sit ups, push ups, and various forms of "crunches" are performed on a horizontal surface. Other exercises employ weights such as dumbbells to strengthen the arms.

BRIEF SUMMARY OF THE INVENTION

The present invention is directed to and exercise system which can be used on either the mattress of a bed or on the floor. The present invention provides an alternative method for exercising the entire body, wherein exercises may be performed on a bed. The present invention is particularly advantageous for people with limited mobility who are just starting a rehabilitation program or people who can no longer get down on the floor to work their abdominals or lower back. The exercise system includes a top mat which is placed on top of a bottom mat. The bottom mat serves as the foundation. It helps keep a firm surface for the top mat so the user can complete abdominal crunches and other exercise without sinking or swaying while on the bed. A pair of handles are connected to the upper portion of the top mat by line. The upper portion of the top mat is used for support. During a crunch exercise, the handles pull the upper portion of top mat off of the surface of the mattress. This helps support the head, neck and shoulders while the user holds the handles to complete an upper abdominal crunch. The exercise system also includes a support pad which helps support the lower back when doing any type of lower abdominal movements.

In accordance with a preferred embodiment of the invention, an exercise system for use on a bed having a mattress or for use on a floor includes (1) a top mat having a first end portion and an opposite second end portion, (2) two handles, and (3) at least one line for connecting the handles to the first end portion of the top mat.

In accordance with an aspect of the invention, the handles are dumbbells.

In accordance with another aspect of the invention, the line connects the two handles. The top mat has a longitudinal axis, and the first end portion includes a transverse member which is oriented perpendicular to the longitudinal axis. The line is connected to the transverse member.

In accordance with another aspect of the invention, the transverse member is a tube which slidably receives the line.

In accordance with another aspect of the invention, each of the handles includes a retainer for removably connecting the line to the handle. The retainer includes two parallel bores which receive the line.

In accordance with another aspect of the invention, the line is fabricated from a flexible polymer tube.

In accordance with another aspect of the invention, a bottom mat is disposed beneath the top mat.

In accordance with another aspect of the invention, a support pad is removably connectable to the top mat.

In accordance with another aspect of the invention, the top mat has a first connector, and the support pad has a second connector which cooperates with the first connector to removably connect the support pad to the top mat.

In accordance with another aspect of the invention, the mattress has a top surface and a foot. The top mat is disposable on the top surface of the mattress so that second end portion drapes over the foot of the mattress. A ledge is insertable under the mattress near the second end portion.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
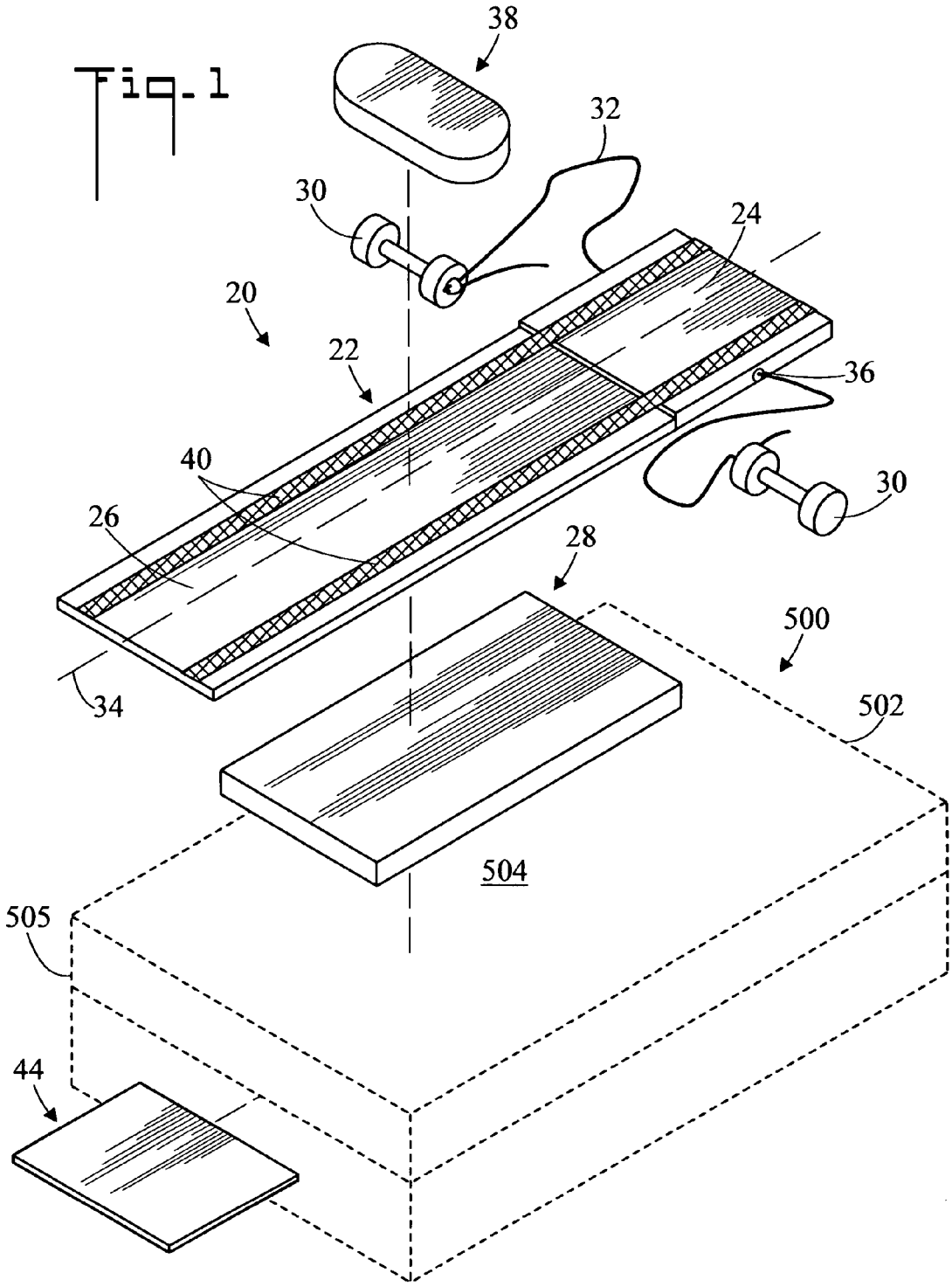
FIG. 1 is an exploded perspective view of an exercise system in accordance with the present invention.
Figure 2:
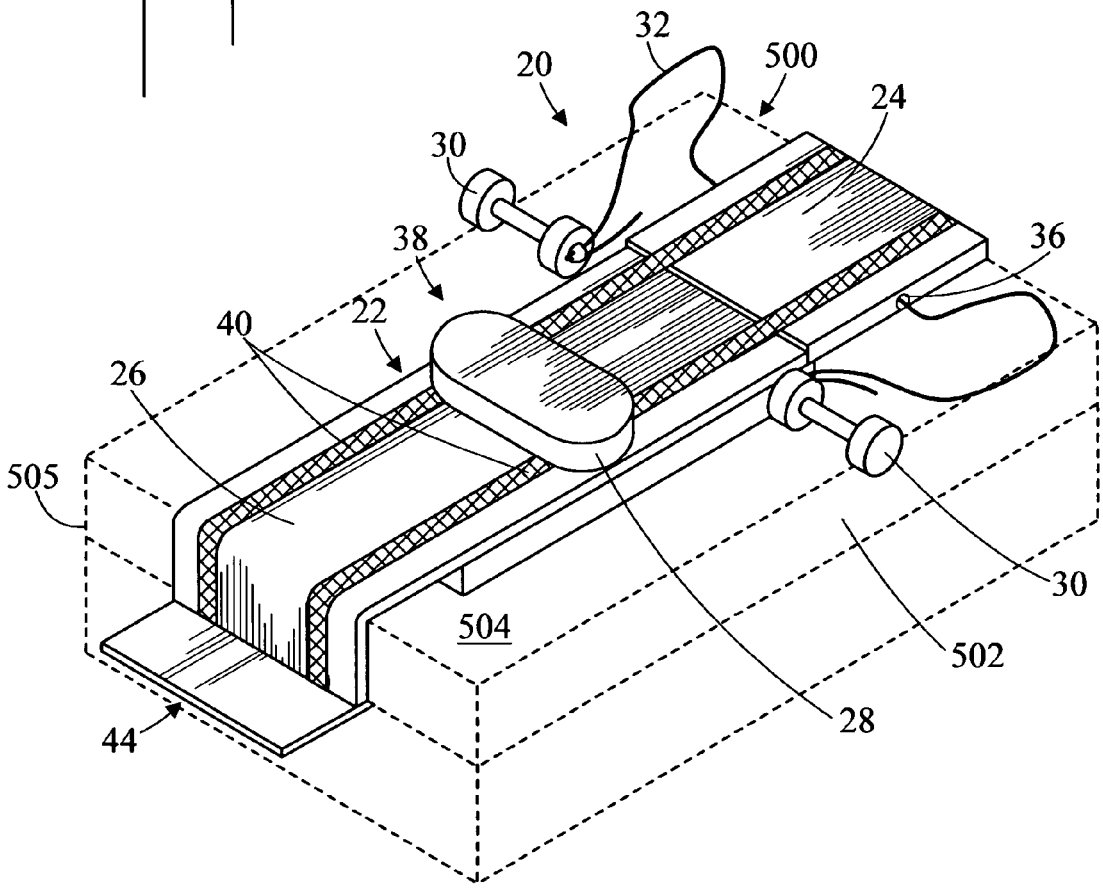
FIG. 2 is a perspective view of the exercise system.

Referring initially to FIGS. 1 and 2, there are illustrated exploded perspective and perspective views respectively of the exercise system in accordance with the present invention, generally designated as 20. In the shown embodiment, exercise system 20 is used on a bed 500 having a mattress 502 having a top surface 504 and a foot 505. However exercise system 20 may also be used on a support surface such as a floor 600 (refer to FIG. 22 and the associated discussion). Exercise system 20 includes a top mat 22 having a first end portion 24 and an opposite second end portion 26 (refer also to FIGS. 3 and 4). In an embodiment of the invention top mat 22 is eight feet long and two feet wide. First end portion 24 is two feet long and second end portion 26 is six feet long. Also, first end portion 24 is two inches thick and second end portion 26 is one an one half inches thick. First end portion 24 is more rigid than second end portion 26 in order to better support the shoulders, neck, and head of the user.

Exercise system 20 further includes a bottom mat 28 (refer also to FIGS. 5 and 6) which is disposed beneath top mat 22. In an embodiment of the invention, bottom mat 28 is four feet long, two feet wide, and two inches thick. When exercise system 20 is used on a bed 500, bottom mat 28 serves as a foundation for top mat 22 so that top mat 22 will not sink into mattress 502 or sway under a user's weight.

Exercise system 20 further includes two handles 30 (refer also to FIG. 12) which are removably connected to first end portion 24 of top mat 22 by at least one line 32. In certain exercises (refer to FIGS. 17-19 and the associated discussions) handles 30 are used to pull up first end portion 24 of top mat 22. In the shown embodiment handles 30 comprise two dumbbells having a weight of one to eight pounds each depending upon the physical condition of the user. The weight of the dumbbells (handles 30) increases the benefits of exercise to enhance muscle development. Additionally as is discussed below, the dumbbells may be detached to perform conventional dumbbell exercises (refer to FIG. 21 and the associated discussion). In the shown embodiment a single line 32 connects the two handles 30. Top mat 22 has a longitudinal axis 34. First end portion 24 includes a transverse member 36 (also refer to FIGS. 3 and 4) which is oriented perpendicular to longitudinal axis 34 and which provides structural support for lifting first end portion 24. In the shown embodiment, transverse member 36 runs the entire width of top mat 22. Line 32 is connected to transverse member 36. In the shown embodiment, transverse member 36 is a tube (made of metal or a rigid polymer) which slidably receives line 32 (also refer to FIG. 13 and the associated discussion). It may be appreciated that other connections of handles 30 to first end portion 24 by line 32 could also be employed. For example, two lines 32 could be used wherein the one line 32 is connected to each end of transverse member 36. In an embodiment of the invention, line 32 is fabricated from a flexible polymer tube.

Exercise system 20 also includes a support pad 38 (refer also to FIGS. 7-9) which is removably connectable to top mat 22, and may be placed at various locations on top mat 22. For example, support pad 38 may be used to support the lower back (refer to FIGS. 17-19), head/neck (refer to FIG. 20 respectively), or other body part of the user. Top mat 22 has a first connector 40, and support pad 38 has a second connector 42 (refer to FIG. 9) which cooperates with first connector 40 to removably connect support pad 38 to top mat 22. In the shown embodiment, first connector 40 and second connector 42 are the cooperating portions of a hook and loop connector. In an embodiment of the invention, top mat 22, bottom mat 28, and support pad 38 are fabricated from a foam material which is covered by vinyl or another polymer.

In FIG. 2 it is noted that top mat 22 is disposable on the top surface 504 of mattress 502 so that second end portion 26 drapes over foot 505 of mattress 502. Exercise system 20 further includes a ledge 44 (refer also to FIGS. 10 and 11) which is insertable under mattress 502 near second end portion 26. Ledge 44 may be fabricated from any convenient planar member (such as plywood), and serves to support the feet of the user during certain exercises (refer to FIG. 21 and the associated discussion).

Figure 3:
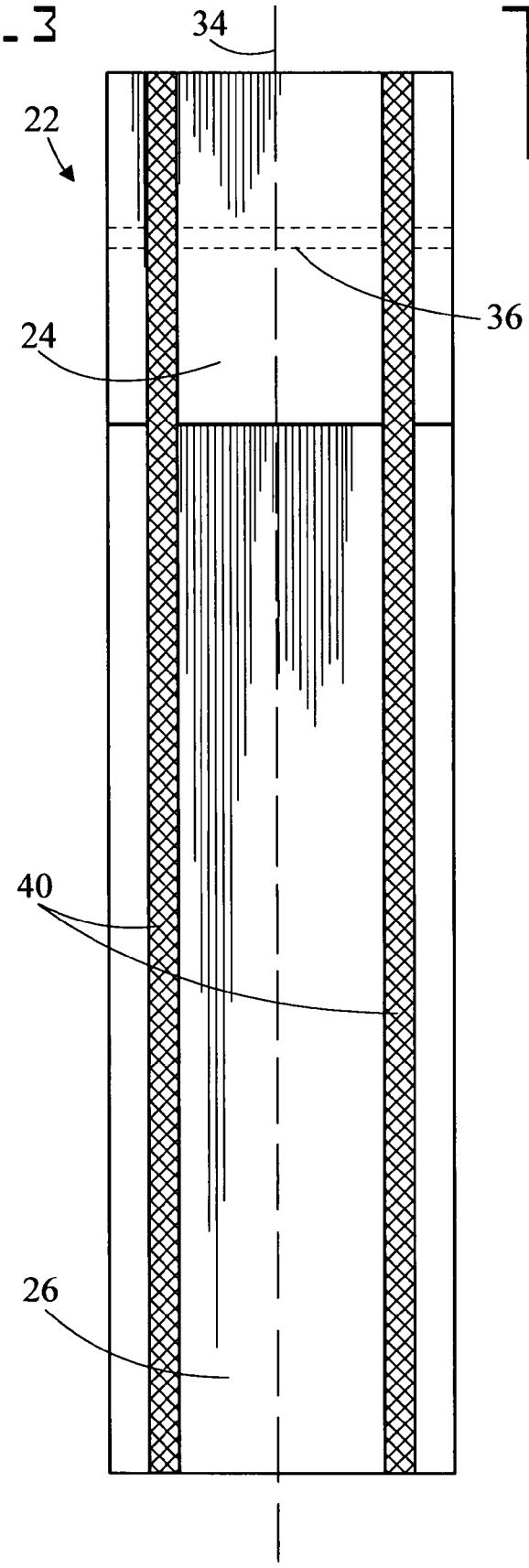
FIG. 3 is an enlarged top plan view of a top mat.
Figure 4:
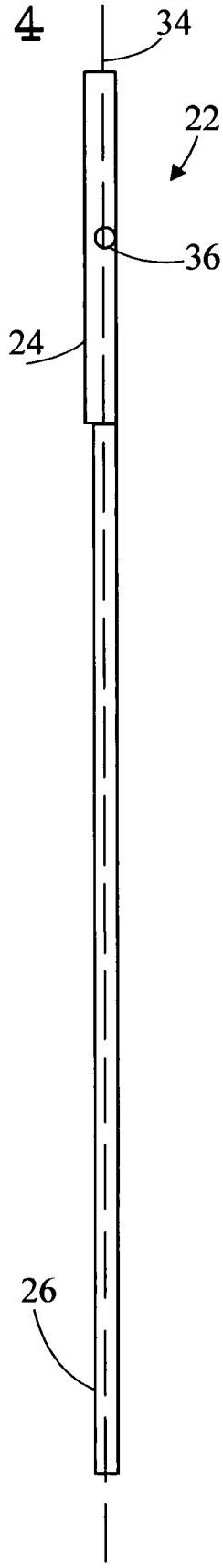
FIG. 4 is an enlarged side elevation view of the top mat.

FIGS. 3 and 4 are enlarged top plan and side elevation views respectively of top mat 22, showing first end portion 24, second end portion 26, centerline 34, transverse member 36, and first connector 40. In the shown embodiment, first connector 40 includes two spaced apart strips of hook and loop material.

Figure 5:
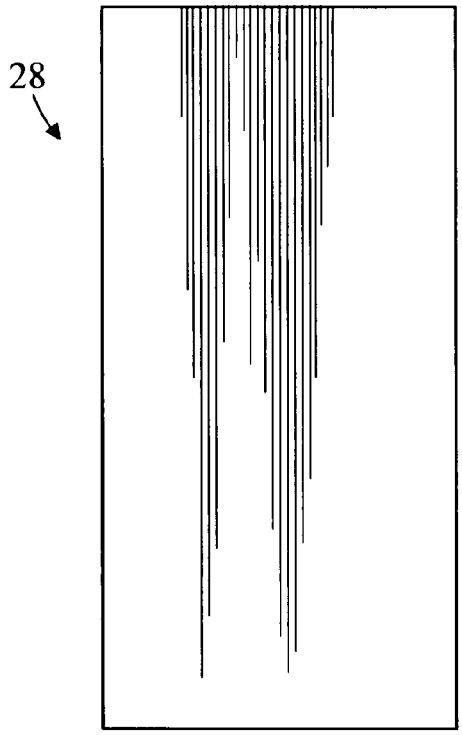
FIG. 5 is an enlarged top plan view of a bottom mat.
Figure 6:
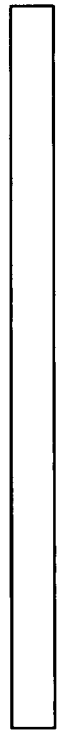
FIG. 6 is an enlarged side elevation view of the bottom mat.

FIGS. 5 and 6 are enlarged top plan and side elevation views respectively of bottom mat 28.

Figure 7:
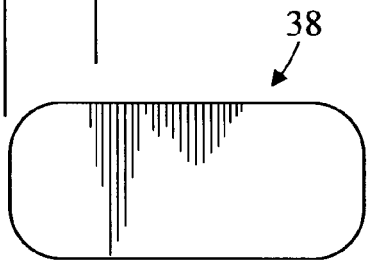
FIG. 7 is an enlarged top plan view of a support pad.
Figure 8:
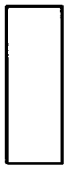
FIG. 8 is an enlarged side elevation view of the support pad.
Figure 9:
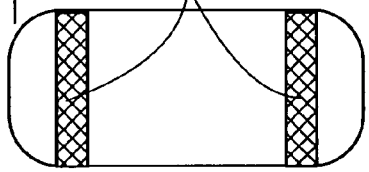
FIG. 9 is an enlarged bottom plan view of the support pad.

FIGS. 7-9 are enlarged top plan, side elevation, and bottom plan views respectively of support pad 38. FIG. 9 shows second connector 42 which cooperates with first connector 40 of top mat 22 (refer to FIG. 3).

Figure 10:
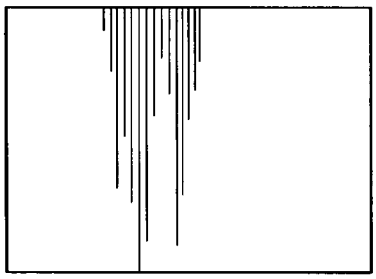
FIG. 10 is an enlarged top plan view of a ledge.
Figure 11:
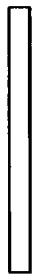
FIG. 11 is an enlarged side elevation view of the ledge.

FIGS. 10 and 11 are enlarged top plan and side elevation views respectively of ledge 44.

Figure 12:
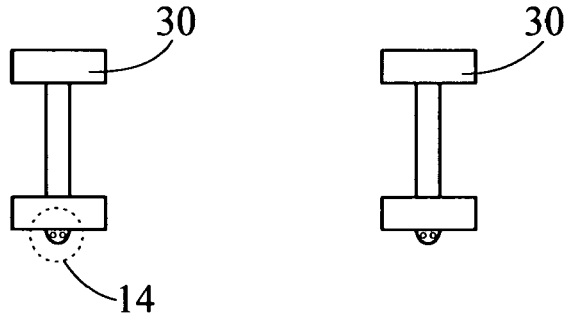
FIG. 12 is an enlarged top plan view of two handles.

FIG. 12 is an enlarged top plan view of two handles 30. In the shown embodiment, handles 30 comprise two dumbbells.

Figure 13:
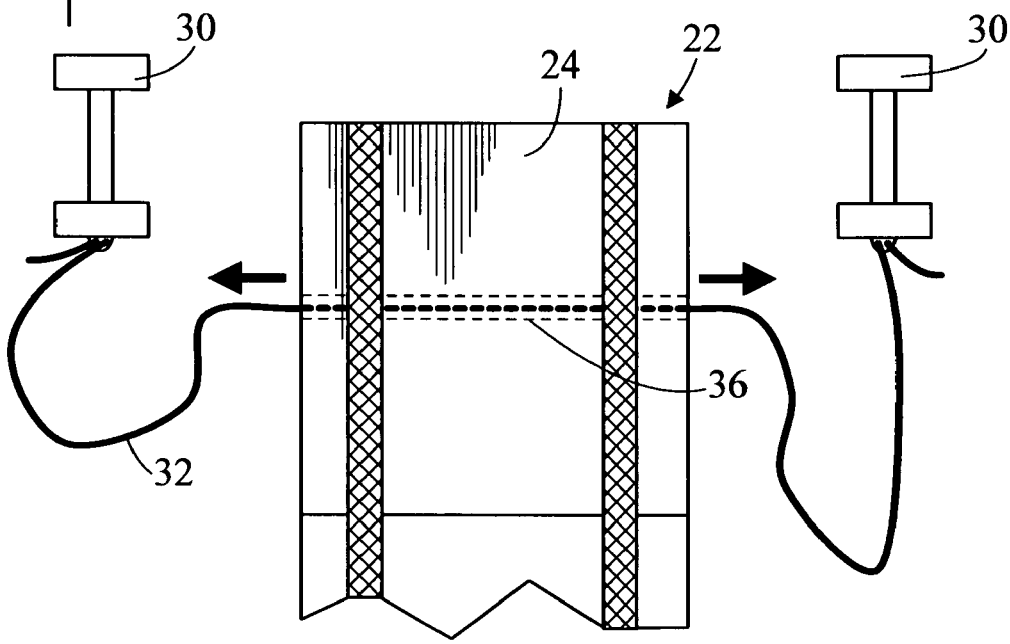
FIG. 13 is an enlarged fragmented top plan view of the first end portion of the top mat connected to the two handles.

FIG. 13 is an enlarged fragmented top plan view of first end portion 24 of top mat 22 connected to two handles 30. In the shown embodiment, transverse member 36 is a tube which slidably receives line 32. Line 32 connects the two handles 30. This configuration allows line 32 to slide in tube 36 until an equal length extends from both sides of first end portion 24.

Figure 14:
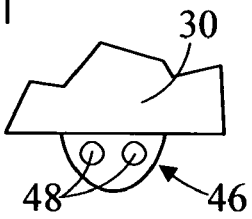
FIG. 14 is an enlarged view of area 14 of FIG. 12.
Figure 15:
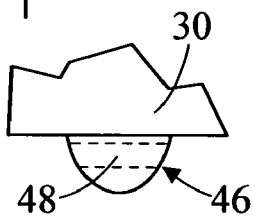
FIG. 15 is an enlarged side elevation view of FIG. 14.
Figure 16:
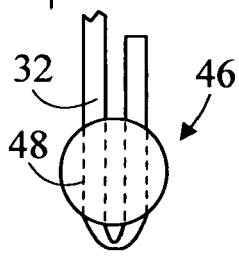
FIG. 16 is an enlarged top plan view of FIG. 14.

FIG. 14 is an enlarged view of area 14 of FIG. 12, FIG. 15 is an enlarged side elevation view of FIG. 14, and FIG. 16 is an enlarged top plan view of FIG. 14. Each handle 30 includes a retainer 46 for removably connecting line 32 to handle 30. In the shown embodiment, retainer 30 includes two parallel bores 48 which receive line 32 and hold it in place. Line 32 is fed into one bore 48 and then fed back in the opposite direction through the other bore 48. It is noted that because line 32 is a hollow tube, it crimps during installation thereby enhancing the grip of retainer 46. The placement of line 32 in retainer 46 determines the length of line 32 so as to accommodate users of different sizes.

Figure 17:
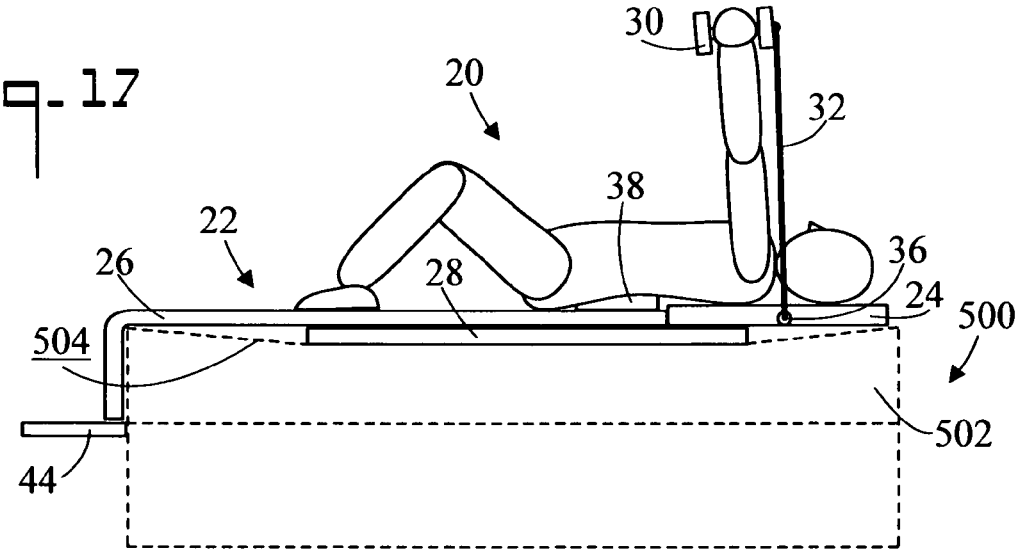
FIG. 17 is a side elevation view of a user using the exercise system on a bed with the user in a first position.
Figure 18:
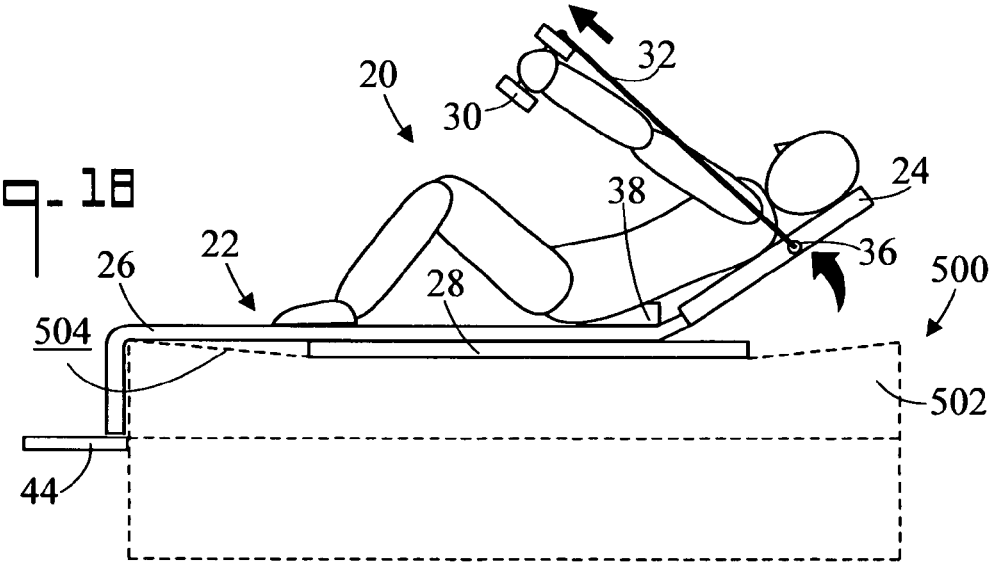
FIG. 18 is a side elevation view of the user in a second position.
Figure 19:
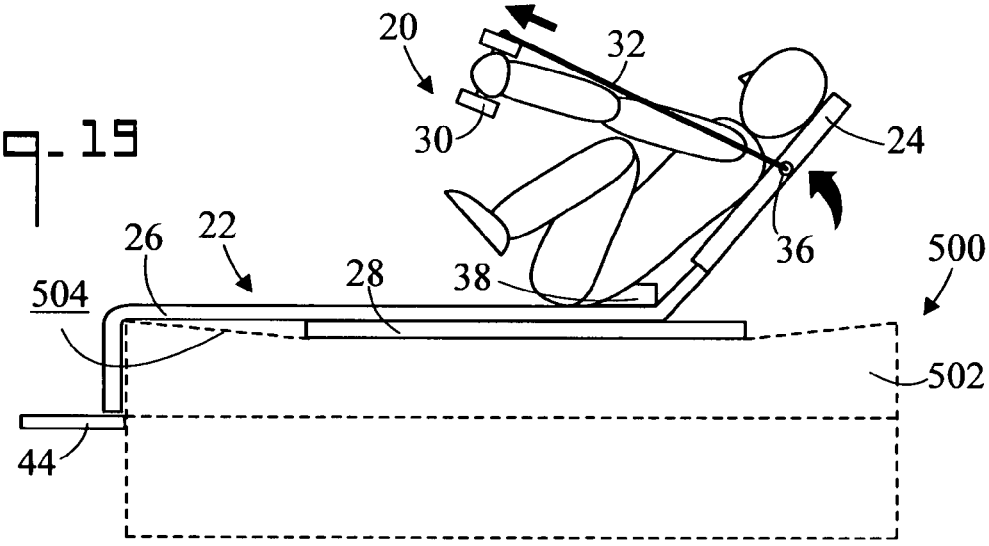
FIG. 19 is a side elevation view of the user in a third position.

FIG. 17 is a side elevation view of a user using exercise system 20 on a bed 500 and mattress 502 with the user in a first position, FIG. 18 is a side elevation view of the user in a second position, and FIG. 19 is a side elevation view of the user in a third position. These three figures show the sequential steps of performing an upper and lower crunch exercise. It is noted that the opposite side view is the mirror image of FIGS. 17-19. In FIG. 17, the user lies on his/her back with the legs bent, grasps handles 30, and places the arms in a straight up position. Support pad 38 is positioned beneath the lower back of the user.

In FIG. 18, the user curls the upper spine, pulls forward using the abdominal muscles thereby causing line 32 to pull first end portion 24 of top mat 22 up away from mattress 502. It is noted that first end portion 24 supports (cradles) the head, neck, and shoulders of the user, thereby reducing neck strain. Transverse member 36 provides structural support and rigidity when first end portion 24 is pulled up. It is noted that line 32 can be lengthened to help trigger more fibers in the upper body to work a little harder, thereby strengthening other parts of the body.

In FIG. 19, the user brings up his/her knees to meet the chest and complete the crunch exercise. The user then slowly rolls back down to assume the position of FIG. 17, and the sequence is repeated. It is noted that exercise system 20 may also be used to perform other exercises such as chest presses, chest flys, triceps extensions, and the like.

Figure 20:
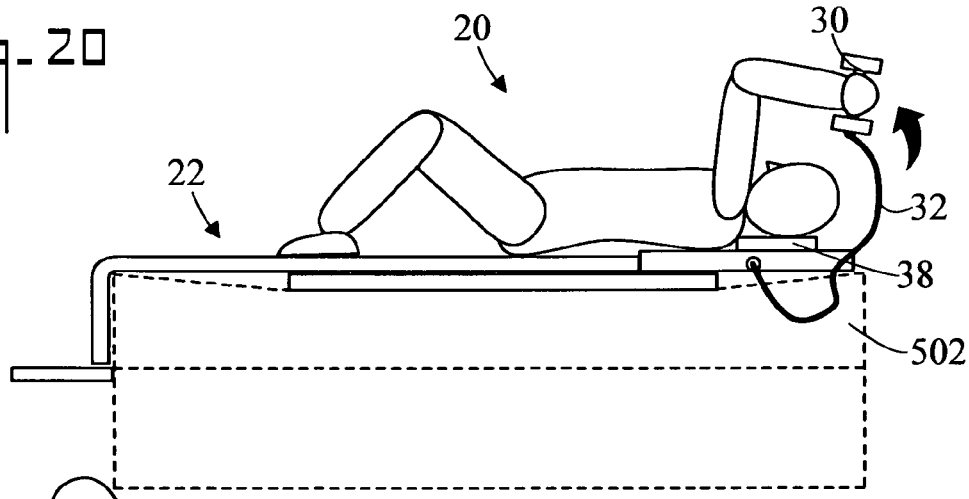
FIG. 20 is a side elevation view of the user in another exercise position.

FIG. 20 is a side elevation view of the user in another exercise position. In this position the user lies on his/her back on top of mattress 502 and lifts handles 30 to exercise the triceps muscles of the arms. It is noted that support pad 38 has been placed under the head of the user.

Figure 21:
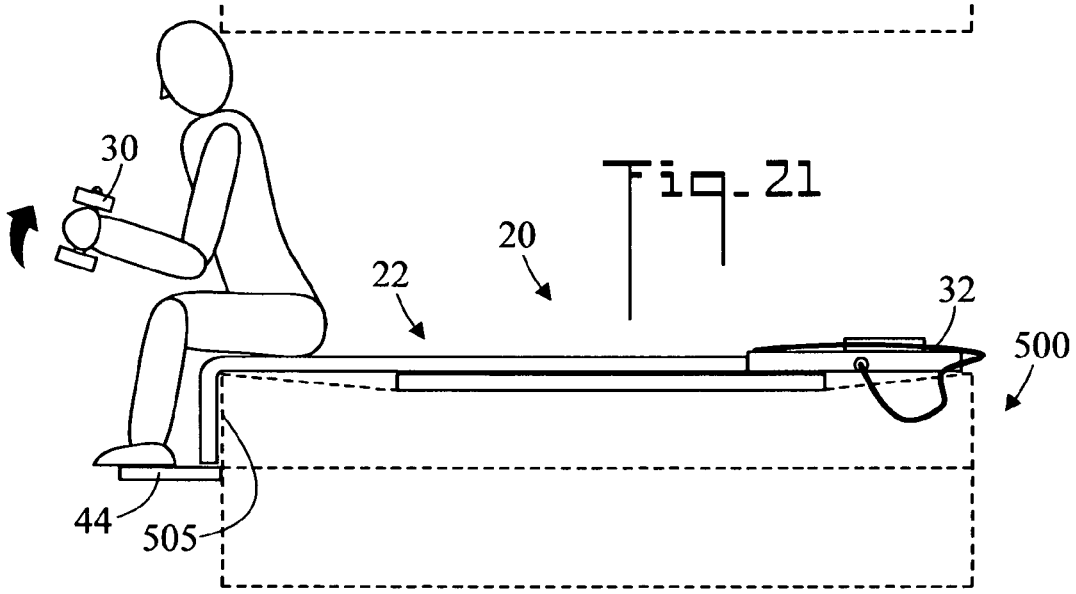
FIG. 21 is a side elevation view of the user in another exercise position; and, FIG. 22 is a side elevation of a user using the exercise system on a support surface such as a floor.

FIG. 21 is a side elevation view of the user in another exercise position. In this position handles 30 have been detached from line 32 (by disconnecting line 32 from ratainer 46, refer to FIG. 16). The user sits on the foot 505 of the bed 500 and places his/her feet on ledge 44, and lifts handle(s) 30 to exercise the biceps muscles of the arms. It may be appreciated that with handles 30 disconnected from line 32, the user is free to perform any handle 30 (dumbbell) related exercise, even when walking or jogging. Ledge 44 can also be used as a step up platform to exercise leg muscles. Another possibility is as seat when doing [seated] light upper body exercises.

Figure 22:
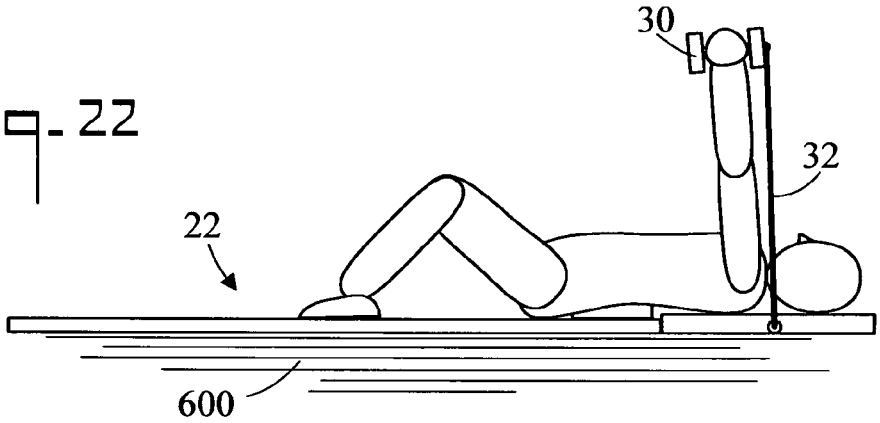

FIG. 22 is a side elevation of a user using the exercise system 20 on a support surface 500 such as a floor. For example, the user could perform the same exercises on the floor as were performed on bed 500 in FIGS. 17-19. It is noted that bottom mat 28 has been removed in this embodiment.

Referring to FIGS. 1-22, in terms of use a method for a user to exercise includes:

(a) providing an exercise system 20 including:

a top mat 22 having a first end portion 24 and an opposite second end portion 26;

two handles 30;

at least one line 32 for connecting handles 30 to first end portion 24 of top mat 22;

a bottom mat 24;

(b) providing a bed 500 having a mattress 502 having a top surface 504 and a foot 505;

(c) placing bottom mat 28 on top surface 504 of mattress 502;

(d) placing top mat 22 on top of bottom mat 28;

(e) using the at least one line 32 to connect two handles 30 to first end portion 24 of top mat 22;

(f) the user assuming an exercise position on top of top mat 22; and, (g) the user performing an exercise.

The method further including:

in step (a), handles 30 being dumbbells.

The method further including:

in step (a), line 32 connecting two handles 30;

in step (a), top mat 22 having a longitudinal axis 34;

in step (a), first end portion 24 including a transverse member 36 oriented perpendicular to longitudinal axis 34; and, during step (e), connecting the at least one line 32 to transverse member 36.

The method further including:

in step (a), transverse member 36 being a tube which slidably receives line 32; and, during step (e), routing line 32 through tube 36.

The method further including:

in step (a), each of handles 30 including a retainer 46 for removably connecting line 32 to handle 30;

in step (a), retainer 46 including two parallel bores 48 which receive line 32; and, in step (e), the connection of handles 30 to line 32 including feeding line 32 through one of the bores 48 and back through the other of the bores 48.

The method further including:

in step (a), the at least one line 32 being fabricated from a flexible polymer tube.

The method further including:

during step (e), adjusting a length of line 32 between handles 30.

The method further including:

during step (f), the user lying down with his/her back on top mat 22 and grasping one handle 30 in each hand; and, during step (g), the user extending handles 30 so that line 32 becomes taught and urges first end portion 24 up away from surface 504 of mattress 502 thereby supporting the head, neck, and shoulders of the user.

The method further including:

in step (a), handles 30 being dumbbells; and, after step (g), disconnecting dumbbells 30 from the at least one line 32; and, using dumbbells 30 to perform exercises.

The method further including:

in step (a) providing a support pad 38 which is connectable to top mat 22; and, prior to step (g), connecting support pad 38 to a desired location on top mat 22.

The method further including:

in step (d), second end portion 26 of top mat 22 draping over foot 505 of mattress 502;

in step (a) providing a ledge 44;

prior to step (f), inserting ledge 44 under foot 505 of mattress 505; and, during step (g), the user placing his/her feet on ledge 44.

The preferred embodiments of the invention described herein are exemplary and numerous modifications, variations, and rearrangements can be readily envisioned to achieve an equivalent result, all of which are intended to be embraced within the scope of the appended claims.

I claim:

1. An exercise system for use on a bed having a mattress, or for use on a floor, by a user having various body parts, said exercise system comprising:

a top mat;

said top mat having a first end portion and an opposite second end portion;

two handles;

a line for connecting said handles to said first end portion of said top mat;

a bottom mat separate from said top mat disposable beneath said top mat, said bottom mat serving as a foundation for said top mat so that said top mat will not sink into the mattress under the user's weight;

a separate support pad removably connectable to said top mat, said support pad placeable at various locations on said top mat to support the various body parts of the user;

said top mat having a first connector which includes two parallel spaced apart strips;

said support pad having a second connector which cooperates with said first connector to removably connect said support pad to said top mat, and, said first and second connectors being cooperating hook and loop connectors.

2. An exercise system for use on a bed having a mattress having a top surface and a foot, or for use on a floor, said exercise system comprising:

a top mat;

said top mat having a first end portion and an opposite second end portion;

two handles;

a line for connecting said handles to said first end portion of said top mat;

said line connecting said two handles;

said top mat having a longitudinal axis;

said first end portion including a transverse member oriented perpendicular to said longitudinal axis, said transverse member running the width of said top mat and providing structural support when said first end portion is pulled up;

said transverse member being a tube which slidably receives said line;

said handles being dumbbells;

each of said handles including a retainer for removably connecting said line to said handle;

said line being fabricated from a flexible polymer tube;

a bottom mat disposed beneath said top mat;

said top mat having a first connector;

said support pad having a second connector which cooperates with said first connector to removably connect said support pad to said top mat;

said top mat disposable on the top surface of the mattress so that second end portion drapes over the foot of the mattress; and, a ledge which is insertable under the mattress near said second end portion.

3. A method for a user to exercise, comprising:

(a) providing an exercise system including:

a top mat, said top mat having a first end portion and an opposite second end portion;

two handles;

a line for connecting said handles to said first end portion of said top mat;

a bottom mat separate from said top mat;

(b) providing a bed having a mattress having a top surface and a foot;

(c) placing said bottom mat on said top surface of said mattress, said bottom mat serving as a foundation for said top mat so that said top mat will not sink into the mattress under the user's weight;

(d) placing said top mat on top of said bottom mat;

(e) using said line to connect said two handles to said first end portion of said top mat;

(f) the user assuming an exercise position on top of said top mat; and, (g) the user performing an exercise.

4. The method of claim 3, further including:

in step (a), said line connecting said two handles;

in step (a), said top mat having a longitudinal axis;

in step (a), said first end portion including a transverse member oriented perpendicular to said longitudinal axis, said transverse member running the width of said top mat and providing structural support when said first end portion is pulled up; and, during step (e), connecting said line to said transverse member.

5. The method of claim 4, further including:

in step (a), said transverse member being a tube which slidably receives said line; and, during step (e), routing said line through said tube and sliding said line in said tube until equal lengths extend from both sides of said first end portion.

6. The method of claim 3, further including:

in step (a) providing a separate support pad which is removably connectable to said top mat, said support pad placeable at various locations on said top mat to support the various body parts of the user; and, prior to step (g), connecting said support pad to a desired location on said top mat.

7. The method of claim 3, further including:

in step (d), said second end portion draping over said foot of said mattress;

in step (a), providing a ledge;

prior to step (f), inserting said ledge under said foot of said mattress; and, during step (g), the user placing his/her feet on said ledge.

* * * * *